US010614741B2

(12) United States Patent
Hashimoto

(10) Patent No.: US 10,614,741 B2
(45) Date of Patent: Apr. 7, 2020

(54) DISPLAY DEVICE DRIVEN WITH VOLTAGE TO TIME CONVERTERS

(71) Applicant: InnoLux Corporation, Miao-Li County (TW)

(72) Inventor: Kazuyuki Hashimoto, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/024,923

(22) Filed: Jul. 2, 2018

(65) Prior Publication Data

US 2019/0325806 A1 Oct. 24, 2019

Related U.S. Application Data

(60) Provisional application No. 62/659,717, filed on Apr. 19, 2018.

(51) Int. Cl.
*G09G 3/32* (2016.01)
*G09G 3/20* (2006.01)

(52) U.S. Cl.
CPC ..... *G09G 3/2018* (2013.01); *G09G 3/32* (2013.01); *G09G 2300/0814* (2013.01); *G09G 2300/0819* (2013.01); *G09G 2310/08* (2013.01); *G09G 2320/0247* (2013.01)

(58) Field of Classification Search
CPC ..... G09G 3/2018; G09G 3/32; G09G 2300/0814; G09G 2300/0819; G09G 2310/08; G09G 2320/0247; G09G 3/3258; G09G 3/3283; G09G 3/3648; G09G 3/3208; G09G 3/2092; G09G 3/3241; G09G 3/3233
See application file for complete search history.

(56) References Cited

U.S. PATENT DOCUMENTS

| | | | | |
|---|---|---|---|---|
| 8,531,116 | B2 | 9/2013 | Min | |
| 2002/0140659 | A1* | 10/2002 | Mikami | G09G 3/3258 345/90 |
| 2005/0057455 | A1* | 3/2005 | Peng | G09G 3/3208 345/76 |
| 2008/0131017 | A1* | 6/2008 | Borel | G09G 3/3648 382/255 |
| 2010/0156766 | A1* | 6/2010 | Levey | G09G 3/3233 345/78 |
| 2017/0090225 | A1 | 3/2017 | Asahi | |
| 2017/0243530 | A1* | 8/2017 | Kwon | G09G 3/2092 |

(Continued)

*Primary Examiner* — Richard J Hong
(74) *Attorney, Agent, or Firm* — Winston Hsu

(57) ABSTRACT

A display device includes at least one data line, at least one scan line, and at least one pixel circuit. The pixel circuit is coupled to a corresponding data line and a corresponding scan line. The pixel circuit includes a light emitting diode (LED), a voltage to time converter, a selection circuit, and a current driver. The current driver is coupled to the LED for controlling the LED. The selection circuit transmits the data voltage of a data line to the voltage to time converter during the scan operation. The voltage to time converter includes an input terminal for receiving the data voltage, and an output terminal for turning on the LED to generate a predetermined driving current for a period of time. When the absolute value of the data voltage is greater, the period of time is longer.

18 Claims, 9 Drawing Sheets

(56) References Cited

U.S. PATENT DOCUMENTS

| | | | | |
|---|---|---|---|---|
| 2018/0182286 | A1* | 6/2018 | Ahmed | G09G 3/3283 |
| 2018/0182294 | A1* | 6/2018 | Radhakrishnan | G09G 3/3241 |
| 2018/0182295 | A1* | 6/2018 | Ahmed | G09G 3/3241 |

* cited by examiner

DISPLAY DEVICE DRIVEN WITH VOLTAGE TO TIME CONVERTERS

CROSS REFERENCE TO RELATED APPLICATION

This non-provisional application claims priority of U.S. provisional application No. 62/659,717, filed on Apr. 19, 2018, included herein by reference in its entirety.

BACKGROUND OF THE DISCLOSURE

1. Field of the Disclosure

The present disclosure is related to a display device, especially to a display device driven with voltage to time converters.

2. Description of the Prior Art

Display devices have been widely used in a variety of applications, such as smart phones, personal computers, and electronic book readers. However, according to usage scenarios of the applications, different types of display devices may be chosen. Among different types of display devices, light emitting diode (LED) display devices, such as mini-LED display devices, micro-LED display devices, and organic light emitting diode (OLED) display devices, are popular ones.

Usually these display devices include a plurality of current drivers, each controlling the luminance of a light emitting unit in a pixel. However, since the chromaticity of LED is current dependent and the LED operation may become unstable when the driving current is rather low, the LED operation using pulse width modulation (PWM) with a fixed optimum LED current has been proposed. However, to support higher grey scale with PWM operation, the scan frequency will become lower, causing a flickering issue.

SUMMARY OF THE DISCLOSURE

One embodiment of the present disclosure discloses a display device. The display device includes at least one data line, at least one scan line, and at least one pixel circuit.

Each of the pixel circuit includes a light emitting diode (LED), a current driver, a voltage to time converter, and a selection circuit.

The current driver is coupled to the LED for controlling the LED. The voltage to time converter includes an input terminal for receiving a data voltage during a scan operation of the pixel circuit, and an output terminal for turning on the current driver to generate a predetermined driving current for a period of time. The selection circuit is coupled to a current data line of the at least one data line, the input terminal of voltage to time converter, and a current scan line of the at least one scan line. The selection circuit transmits the data voltage of the current data line to the voltage to time converter during the scan operation of the pixel circuit. When the absolute value of the data voltage is greater, the period of time is longer.

Another embodiment of the present disclosure discloses a method for displaying an image with a display device. The display device includes a first row of pixels and a second row of pixels.

The method includes the first row of pixels receiving data voltages corresponding to the image and each pixel of the first row of pixels turning on an LED for a first period of time during a first scan operation of the first row of pixels, and the second row of pixels receiving data voltages corresponding to the image, and each pixel of the second row of pixels turning on an LED for a second period of time during a second scan operation of the second row of pixels. When an absolute value of a data voltage received by the each pixel of the first row of pixels is greater, the first period of time is longer, and when an absolute value of a data voltage received by the each pixel of the second row of pixels is greater, the second period of time is longer. The first scan operation begins before the second scan operation.

These and other objectives of the present disclosure will no doubt become obvious to those of ordinary skill in the art after reading the following detailed description of the embodiment that is illustrated in the various figures and drawings.

DETAILED DESCRIPTION

Figure 1:
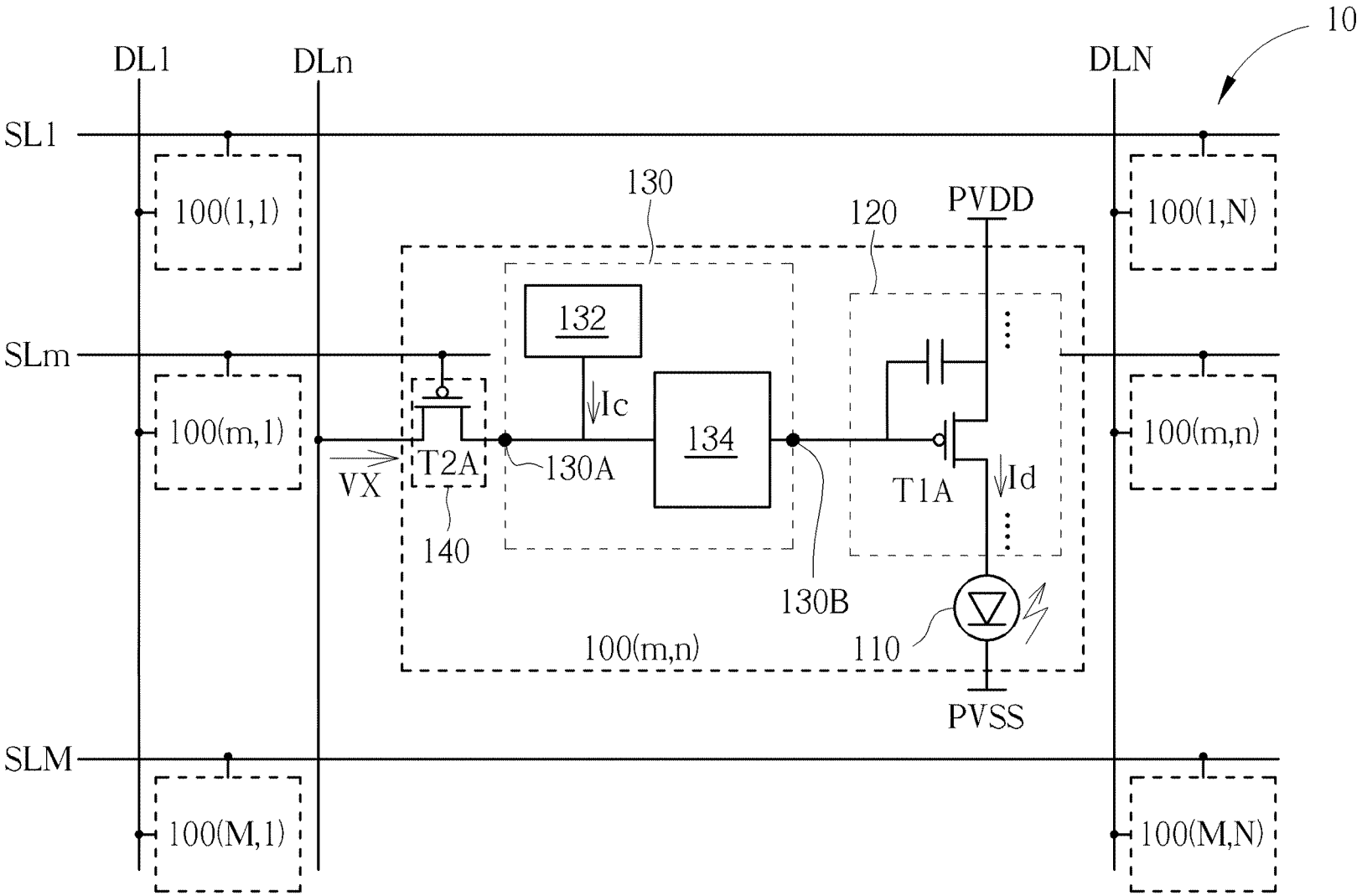
FIG. 1 shows a display device according to one embodiment of the present disclosure.

FIG. 1 shows a display device 10 according to one embodiment of the present disclosure. The display device 10 includes data lines DL1 to DLN, scan lines SL1 to SLM, and M×N pixel circuits 100(1, 1) to 100(M, N), where M and N are positive integers.

In some embodiments, the pixel circuits 100(1, 1) to 100(M, N) can have the same structures, and the pixel circuit 100(*m, n*) is taken as an example to show the structures in FIG. 1.

The pixel circuit 100(*m, n*) includes a light emitting diode (LED) 110, a current driver 120, a voltage to time converter 130, and a selection circuit 140. The LED 110 has a first electrode, and a second electrode for receiving a first system voltage PVSS. The current driver 120 is coupled to the first electrode of the LED 110 and can control the LED 110. For example, in FIG. 1, the current driver 120 includes a first thin film transistor (TFT) T1A coupled to the LED 110.

The voltage to time converter 130 includes an input terminal 130A for receiving a data voltage VX, and an output terminal 130B for turning on the first TFT T1A to generate a predetermined driving current Id for a period of time during the scan operation. The voltage to time converter 130 can determine the period of time for turning on the first TFT T1A according to the value of the data voltage VX received. In some embodiments, when the absolute value of the data voltage is greater, the period of time is longer, resulting in presenting a higher grey scale. Also, in some embodiments, the grey scale may be related to the difference between a threshold voltage of the voltage to time converter 130 and the data voltage VX received by the voltage to time converter 130. In this case, the greater voltage difference between a threshold voltage of the voltage to time converter 130 and the data voltage VX, the longer the voltage to time converter 130 will turn on the first TFT T1A, resulting in presenting a higher grey scale.

In addition, to control the scan operation for receiving the data voltage and presenting the corresponding grey scale, the pixel circuit 100(*m, n*) further includes the selection circuit 140. The selection circuit 140 is coupled to a current data line DLn of the data lines DL1 to DLN, a current scan line SLm of the scan lines SL1 to SLM, and the input terminal 130A of the voltage to time converter 130. The selection circuit 140 can be used to transmit the data voltage VX of a current data line DLn of the data lines DL1 to DLN to the voltage to time converter 130 during the scan operation.

For example, the selection circuit 140 can include a second TFT T2A. The second TFT T2A has a first terminal, a second terminal, and a control terminal. The first terminal of the second TFT T2A is coupled to a current data line DLn of the data lines DL1 to DLN, the second terminal of the second TFT T2A is coupled to the input terminal 130A of the voltage to time converter 130, and the control terminal of the second TFT T2A is coupled to a current scan line SLm of the scan lines SL1 to SLM. That is, by turning on or turning off the second TFT T2A with the scan line SLm, the data voltage VX of the data line DLn can be transmitted to the voltage to time converter 130 through the second TFT T2A during the desired period of time.

In FIG. 1, the voltage to time converter 130 further includes a current source 132 and a comparator 134. The current source 132 is coupled to the input terminal 130A of the voltage to time converter 130, and can generate a bias current Ic to the input terminal 130A of the voltage to time converter 130. The comparator 134 is coupled to the input terminal 130A and the output terminal 130B of the voltage to time converter 130.

Figure 2:
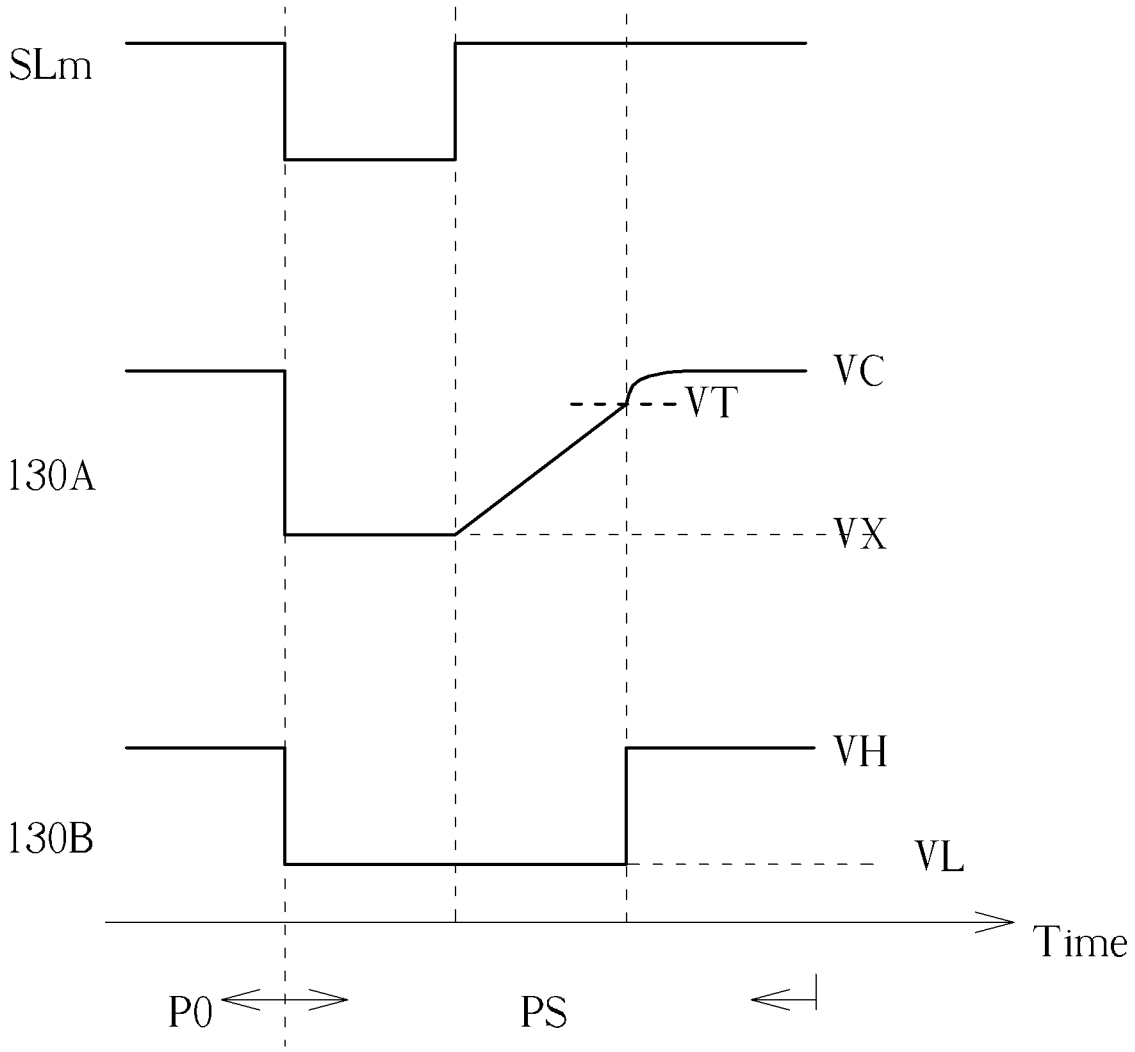
FIG. 2 shows a timing diagram for voltages at the input terminal and the output terminal of the voltage to time converter in FIG. 1.

FIG. 2 shows a timing diagram for voltages at the input terminal 130A and the output terminal 130B of the voltage to time converter 130 in the pixel circuit 100(*m, n*). In the present embodiment, the first TFT T1A and the second TFT T2A are P-type transistors, however, in some other embodiments, the first TFT T1A and the second TFT T2A can be N-type transistors according to the system requirement.

In FIG. 2, in a standby period of time P0 before the scan operation PS starts, the scan line SLm is at a high voltage so the second TFT T2A is turned off. Also, the current source 132 can charge the input terminal 130A of the voltage to time converter 130 to a prepare voltage VC with the bias current Ic. In this case, the voltage to time converter 130 can output a second operation voltage VH to turn off the first TFT T1A.

After the standby period of time P0, the scan operation PS starts. During the scan operation PS in FIG. 2, the second TFT T2A is turned on by the current scan line SLm so the input terminal 130A of the voltage to time converter 130 can receive the data voltage VX from the current data line DLn through the second TFT T2A. In the present embodiment, the prepare voltage VC is designed to be higher than the data voltage VX, and the comparator 134 can be triggered by the voltage drop and output a first operation voltage VL lower than the second operation voltage VH, turning on the first TFT T1A. Thus, the first TFT T1A can be turned on by the first operation voltage VL, which can be designated as a fixed and optimum voltage, to drive the LED 110.

After the data voltage VX is sampled by the voltage to time converter 130, the second TFT T2A will be turned off by the current scan line SLm during the scan operation PS. Therefore, the bias current Ic will start to charge the input terminal 130A of the voltage to time converter 130, and the voltage at the input terminal 130A of the voltage to time converter 130 will be raised. When the input terminal 130A of the voltage to time converter 130 reaches a threshold voltage VT of the comparator 134 from the data voltage VX, the output terminal 130B of the voltage to time converter 130 will change from the first operation voltage VL to the second operation voltage VH. Therefore, the first TFT T1A will be turned off and stop driving the LED 110. That is, the greater the absolute value of the voltage difference between the threshold voltage VT and the data voltage VX received by the voltage to time converter 130, the longer the voltage to time converter 130 will turn on the first TFT T1A, resulting in presenting a higher grey scale.

In the present embodiment, the prepare voltage VC is higher than the threshold voltage VT, and the threshold voltage VT is higher than the data voltage VX. However, in some other embodiments, the threshold voltage VT may be lower than the data voltage VX. That is, the difference between the data voltage and the threshold voltage can be designated to be positive value or negative value according to the system requirement.

Since the current source 132 can charge the input terminal 130A of the voltage to time converter 130 with a fixed and predetermined current Ic, the charging time required to charge the input terminal 130A from the data voltage VX to the threshold voltage VT will be longer if the difference between the data voltage VX and the threshold voltage VT has a greater value. For example, if the data voltage VX is rather low, the charging time would be longer to raise the voltage at the input terminal 130A to the threshold voltage VT. In this case, the LED 110 will be driven to emit light for a longer period of time, resulting in a higher grey scale. In contrast, if the data voltage VX is rather high, the charging time would be shorter and the LED 110 will be driven to emit light for a shorter period of time, resulting in a lower grey scale.

That is, with the voltage to time converter 130, the first TFT T1A can be turned on with a fixed and optimum voltage to generate a stable driving current for a period of time.

Figure 3:
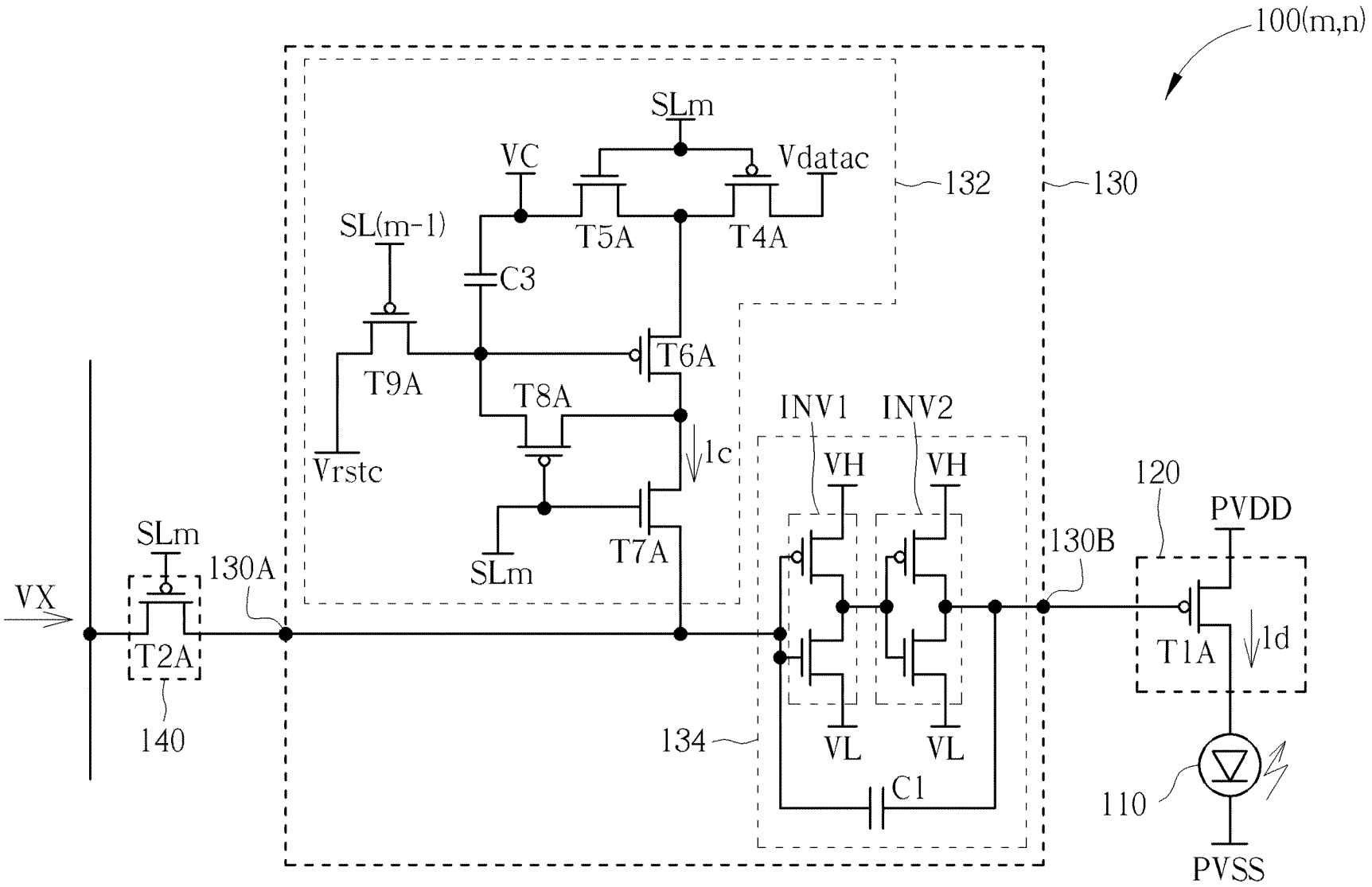
FIG. 3 shows the structures of the pixel circuit in FIG. 1 according to one embodiment of the present disclosure.

FIG. 3 shows the structures of the pixel circuit 100(*m, n*) according to one embodiment of the present disclosure. In FIG. 3, the comparator 134 includes a first inverter INV1, a second inverter INV2, and a first capacitor C1.

The first inverter INV1 has an input terminal, an output terminal, a first power supply terminal, and a second power supply terminal. The input terminal of the first inverter INV1 is coupled to the input terminal of the voltage to time converter 130, the first power supply terminal of the first inverter INV1 receives the first operation voltage VL, and the second power supply terminal of the first inverter INV1 receives the second operation voltage VH.

The second inverter INV2 has an input terminal, an output terminal, a first power supply terminal, and a second power supply terminal. The input terminal of the second inverter INV2 is coupled to the output terminal of the first inverter INV1, the output terminal of the second inverter INV2 is coupled to the output terminal 130B of the voltage to time converter 130, the first power supply terminal of the second inverter INV2 receives the first operation voltage VL, and the second power supply terminal of the second inverter INV2 receives the second operation voltage VH.

The first capacitor C1 has a first terminal, and a second terminal. The first terminal of the first capacitor C1 is coupled to the input terminal of the first inverter INV1, and the second terminal of the first capacitor C1 is coupled to the output terminal of the second inverter INV2.

In this case, when the input terminal 130A of the voltage to time converter 130 receives a high voltage, such as the prepare voltage VC shown in FIG. 2 during the standby period of time P0, the first inverter INV1 will output the first operation voltage VL, and the second inverter INV2 will output the second operation voltage VH, turning off the first TFT T1A.

However, when the second TFT T2A is turned on, and the input terminal 130A of the voltage to time converter 130 receives the data voltage VX lower than the prepare voltage VC, the first inverter INV1 will be triggered to output the second operation voltage VH, and the second inverter INV2 will be triggered to output the first operation voltage VL, turning on the first TFT T1A.

Later, when the second TFT T2A is turned off again, the bias current Ic will charge the first capacitor C1, and the voltage at the input terminal 130A of the voltage to time converter 130 will raise. In this case, when the input terminal 130A of the voltage to time converter 130 reaches the threshold voltage VT of the comparator 134, the first inverter INV1 will be triggered again to output the first operation voltage VL, and the second inverter INV2 will be triggered to output the second operation voltage VH, turning off the first TFT T1A.

However, in some embodiments, due to the characteristic variation of the thin film transistors caused in the manufacturing process, the threshold voltages of the inverters in different pixel circuits may be different, and the uniformity of the display device 10 would be affected. In this case, a third TFT may be used for compensating the variation of the threshold voltage VT.

Figure 4:
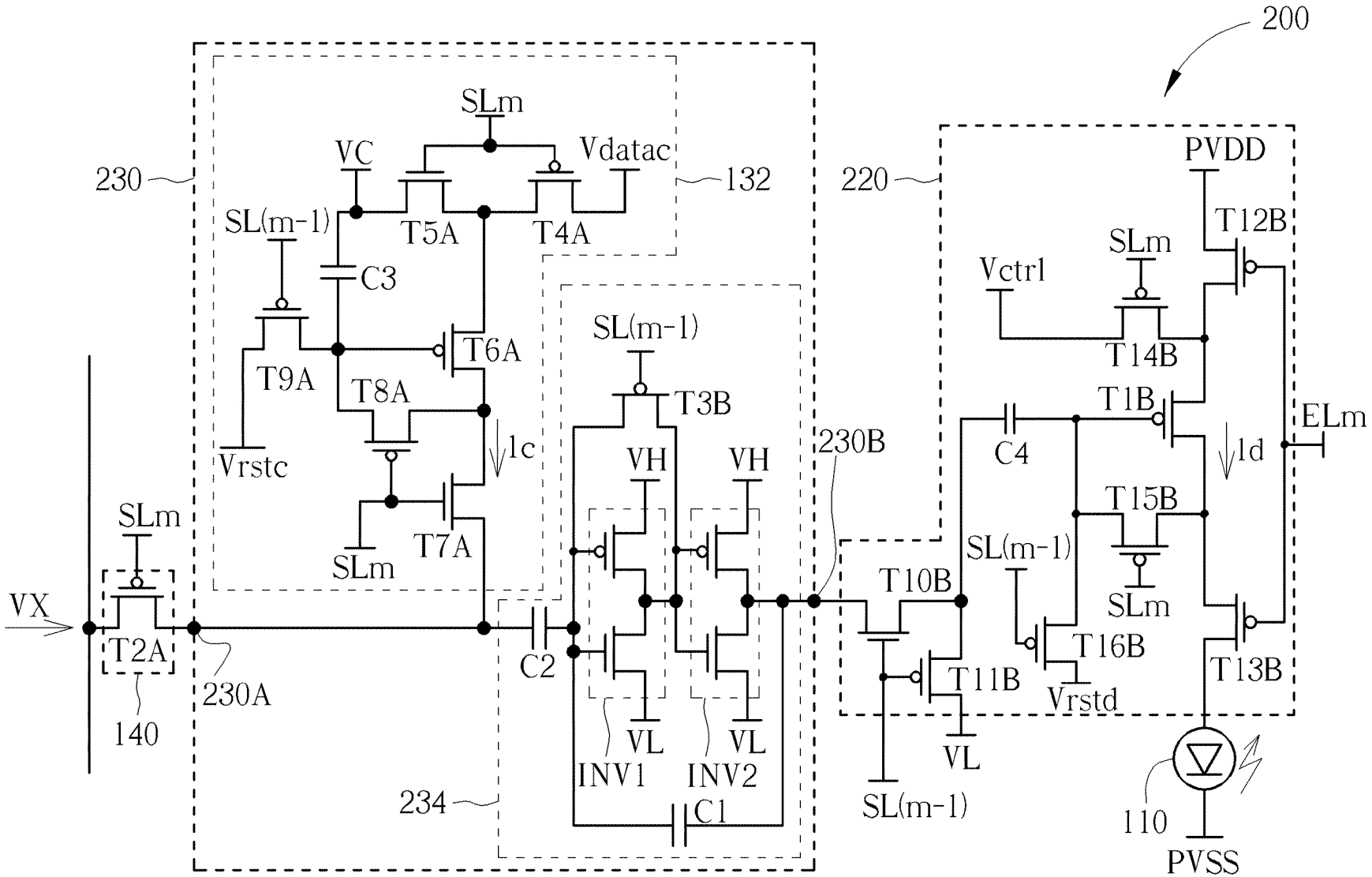
FIG. 4 shows the structures of a pixel circuit according to another embodiment of the present disclosure.

FIG. 4 shows a pixel circuit 200 according to one embodiment of the present disclosure. The pixel circuits 100(*m, n*) and 200 have similar structures and can be operated with similar principles. However, the comparator 234 of the voltage to time converter 230 in the pixel circuit 200 further includes a third TFT T3B and a second capacitor C2.

The third TFT T3B has a first terminal, a second terminal, and a control terminal. The first terminal of the third TFT T3B is coupled to the input terminal of the first inverter INV1, the second terminal of the third TFT T3B is coupled to the input terminal of the second inverter INV2, and the control terminal of the third TFT T3B is coupled to a preceding scan line. For example, when the display device uses the pixel circuit 200 to replace the pixel circuit 100(*m, n*), the control terminal of the second TFT T2A can be coupled to the current scan line SLm of the scan lines SL1 to SLM, and the control terminal of the third TFT T3B can be coupled to the preceding scan line SL(m−1) of the scan lines SL1 to SLM.

The second capacitor C2 has a first terminal and a second terminal. The first terminal of the second capacitor C2 is coupled to the input terminal of the first inverter INV1, and a second terminal of the second capacitor C2 is coupled to the input terminal 230A of the voltage to time converter 230.

In this case, before the scan operation of the pixel circuit 200 starts, the third TFT T3B will be turned on by the preceding scan line SL(m−1) during the scan operation of the preceding pixel circuit. With the third TFT T3B, the input terminal 230A and the output terminal 230B of the voltage to time converter 230 will both be at the threshold voltage VT of the inverter INV1 before entering the scan operation of the pixel circuit 200. Therefore, the variation caused by different threshold voltages in different inverters can be self-compensated.

Furthermore, FIGS. 3 and 4 also show the structure of the current source 132 according to one embodiment of the present disclosure. For example, in FIG. 3, the current source 132 includes a fourth to ninth TFTs T4A to T9A, and a third capacitor C3.

The fourth TFT T4A has a first terminal, a second terminal, and a control terminal. The first terminal of the fourth TFT T4A can receive a bias voltage Vdatac, and the control terminal of the fourth TFT T4A is coupled to the current scan line SLm.

The fifth TFT T5A has a first terminal, a second terminal, and a control terminal. The first terminal of the fifth TFT T5A can receive the prepare voltage VC, the second terminal of the fifth TFT T5A is coupled to the second terminal of the fourth TFT T4A, and the control terminal of the fifth TFT T5A is coupled to the current scan line SLm.

The sixth TFT T6A has a first terminal, a second terminal, and a control terminal. The first terminal of the sixth TFT T6A is coupled to the second terminal of the fourth TFT T4A.

The seventh TFT T7A has a first terminal, a second terminal, and a control terminal. The first terminal of the seventh TFT T7A is coupled to the second terminal of the sixth TFT T6A, the second terminal of the seventh TFT T7A is coupled to the input terminal 130A of the voltage to time converter 130, and the control terminal of the seventh TFT T7A is coupled to the current scan line SLm.

The eighth TFT T8A has a first terminal, a second terminal, and a control terminal. The first terminal of the eighth TFT T8A is coupled to the second terminal of the sixth TFT T6A, the second terminal of the eighth TFT T8A is coupled to the control terminal of the sixth TFT T6A, and the control terminal of the eighth TFT T8A is coupled to the current scan line SLm.

The ninth TFT T9A has a first terminal, a second terminal, and a control terminal. The first terminal of the ninth TFT T9A is coupled to the control terminal of the sixth TFT T6A, the second terminal of the ninth TFT T9A can receive a first reset voltage Vrstc, and the control terminal of the ninth TFT T9A is coupled to the preceding scan line SL(m−1).

The third capacitor C3 has a first terminal and a second terminal. The first terminal of the third capacitor C3 is coupled to the prepare voltage VC, and the second terminal of the third capacitor C3 is coupled to the control terminal of the sixth TFT T6A.

Furthermore, in some embodiments, the fourth TFT T4A, the sixth TFT T6A, the eighth TFT T8A, and the ninth TFT T9A are P-type transistors, and the fifth TFT T5A, the seventh TFT T7A are N-type transistors. In this case, during the scan operation of the preceding pixel circuits, the ninth TFT T9A can be turned on, charging the third capacitor C3.

Furthermore, during the scan operation of the pixel circuit 100, when the current scan line SLm turns on the second TFT T2A, the seventh TFT T7A is turned off so the input terminal 130A of the voltage to time converter 130 can receive the data voltage through the second TFT T2A without being affected by the current source 132.

Meanwhile, the fourth TFT T4A and the eighth TFT T8A are both turned on. In this case, the sixth TFT T6A will remain turned on with its control terminal at a voltage lower than the bias voltage Vdatac by a threshold voltage Vth of the sixth TFT T6A, that is (Vdatac−Vth). The third capacitor C3 can preserve this voltage and keep turning on the sixth TFT T6A to generate the bias current Ic later as the eighth TFT T8A being turned off and the seventh TFT T7A being turned on when the scan line SLm is changed to the high voltage again during the scan operation. Since the voltage for turning on sixth TFT T6A is related to its own threshold voltage Vth, the variations between different sixth TFTs T6A in different pixel circuits can be compensated. Thus, the bias currents Ic generated by different pixel circuits will have better uniformity.

In FIG. 3, the current driver 120 can include the first TFT T1A. The first TFT T1A has a first terminal, a second terminal, and a control terminal. The first terminal of the first TFT T1A can receive the second system voltage PVDD, the second terminal of the first TFT T1A is coupled to the second electrode of the LED 110, and the control terminal of the first TFT T1A can be coupled to the output terminal 130B of the voltage to time converter 130.

However, in FIG. 4, the pixel circuit 200 is similar to the pixel circuit 100, in addition to the first TFT T1B, the current driver 220 can further include a tenth TFT T10B to sixteenth TFT T16B and a fourth capacitor C4 for a finer control.

The tenth TFT T10B has a first terminal, a second terminal, and a control terminal. The first terminal of the tenth TFT T10B is coupled to the output terminal 230B of the voltage to time converter 230, and the control terminal of the tenth TFT T10B is coupled to the preceding scan line SL(m−1).

The eleventh TFT T11B has a first terminal, a second terminal, and a control terminal. The first terminal of the eleventh TFT T11B is coupled to the second terminal of the tenth TFT T10B, the second terminal of the eleventh TFT T11B can receive the first operation voltage VL, and the control terminal of the eleventh TFT T11B is coupled to the preceding scan line SL(m−1).

The fourth capacitor C4 has a first terminal and a second terminal. The first terminal of the fourth capacitor C4 is coupled to the second terminal of the tenth TFT T10B, and the second terminal of the fourth capacitor C4 is coupled to the control terminal of the first TFT T1B.

The twelfth TFT T12B has a first terminal, a second terminal, and a control terminal. The first terminal of the twelfth TFT T12B can receive the second system voltage PVDD, the second terminal of the twelfth TFT T12B is coupled to a first terminal of the first TFT T1B, and the control terminal of the twelfth T12B is coupled to an emission control line ELm.

The thirteenth TFT T13B has a first terminal, a second terminal, and a control terminal. The first terminal of the thirteenth TFT T13B is coupled to a second terminal of the first TFT T1B, the second terminal of the thirteenth TFT T13B is coupled to the first electrode of the LED 110, and the control terminal of the thirteenth TFT T13B is coupled to the emission control line ELm.

The fourteenth TFT T14B has a first terminal, a second terminal, and a control terminal. The first terminal of the fourteenth TFT T14B can receive a control voltage Vctrl, the second terminal of the fourteenth TFT T14B is coupled to the first terminal of the first TFT T1B, and the control terminal of the fourteenth TFT T14B is coupled to the current scan line SLm.

The fifteenth TFT T15B has a first terminal, a second terminal, and a control terminal. The first terminal of the fifteenth TFT T15B is coupled to the second terminal of the first TFT T1B, the second terminal of the fifteenth TFT T15B is coupled to the control terminal of the first TFT T1B, and the control terminal of the fifteenth TFT T15B is coupled to the current scan line SLm.

The sixteenth TFT T16B has a first terminal, a second terminal, and a control terminal. The first terminal of the sixteenth TFT T16B is coupled to the second terminal of the fifteenth TFT T15B, the second terminal of the sixteenth TFT T16B can receive a second reset voltage Vrstd, and the control terminal of the sixteenth TFT T16B is coupled to the preceding scan line SL(m−1).

In this case, the tenth TFT T10B and the eleventh TFT T11B can prevent the current driver 220 from being driven unpredictably by the voltage to time converter 230 during the scan operation of the preceding pixel circuit.

The twelfth TFT T12B and the thirteenth TFT T13B can be controlled by the emission control line Elm to determine the emitting period of time of the LED 110. In some embodiments, since the sample time for the data voltage VX required by the voltage to time converter 230 may be fixed and unrelated to the value of the data voltage VX, the twelfth TFT T12B and the thirteenth TFT T13B can be turned on after the data voltage VX is sampled by the voltage to time converter 230 so that if the voltage difference between the data voltage VX and the threshold voltage VT of the comparator 234 is greater, the emitting period of time would be also be longer. In this case, the emitting period of time will not be affected by the sample time, and the contrast quality can be improved.

In addition, the fourteenth TFT T14B, the fifteenth TFT T15B and the sixteenth TFT T16B can be used to compensate the threshold voltage of the first TFT T1B. Furthermore, in the present embodiment, the first TFT T1B, the eleventh TFT T11B, the twelfth TFT T12B, the thirteenth TFT T13B, the fourteenth TFT T14B, the fifteenth TFT T15B, and the sixteenth TFT T16B are P-type transistors, and the tenth TFT T10B is an N-type transistor.

In this case, the control voltage Vctrl can be designated to be high enough to turn on the fourteenth TFT T14B and the fifteenth TFT T15B when the current scan line SLm is pulled low to turn on the second TFT T2A for sampling the data voltage VX. Therefore, before the twelfth TFT T12B and the thirteenth TFT T13B are turned on, the first TFT T1B will be turned off when the voltage at the control terminal of the first TFT T1B reaches to a voltage lower than the Vctrl within the threshold voltage of the first TFT T1B during the sample time of the scan operation.

Also, the control voltage Vctrl should be low enough to turn on the first TFT T1B during the emitting period of time after the sample time when the twelfth TFT T12B and the thirteenth TFT T13B are turned on. Since the threshold voltage of the first TFT T1B has been recorded by the fourth capacitor C4 during the sample time previously, the threshold voltage of the first TFT T1B can be compensated during the emitting period of time.

In the embodiments shown in FIG. 1 to FIG. 4, during the scan operations of the pixel circuits 100(*m, n*) and 200, after the data voltage VX is sampled, the first TFTs T1A and T1B will be turned on till the bias current Ic changes the voltage at the input terminals 130A and 230A of the voltage to time converters 130 and 230 to be the threshold voltage VT. That is, during the scan operation, the first TFTs T1A and T1B are turned on in the initial stages of the scan operations, and are turned off in the final stages of the scan operations. However, in some embodiments, the first TFT can be turned off in the initial stage of the scan operation, and can be turned on in the final stage of the scan operation.

Figure 5:
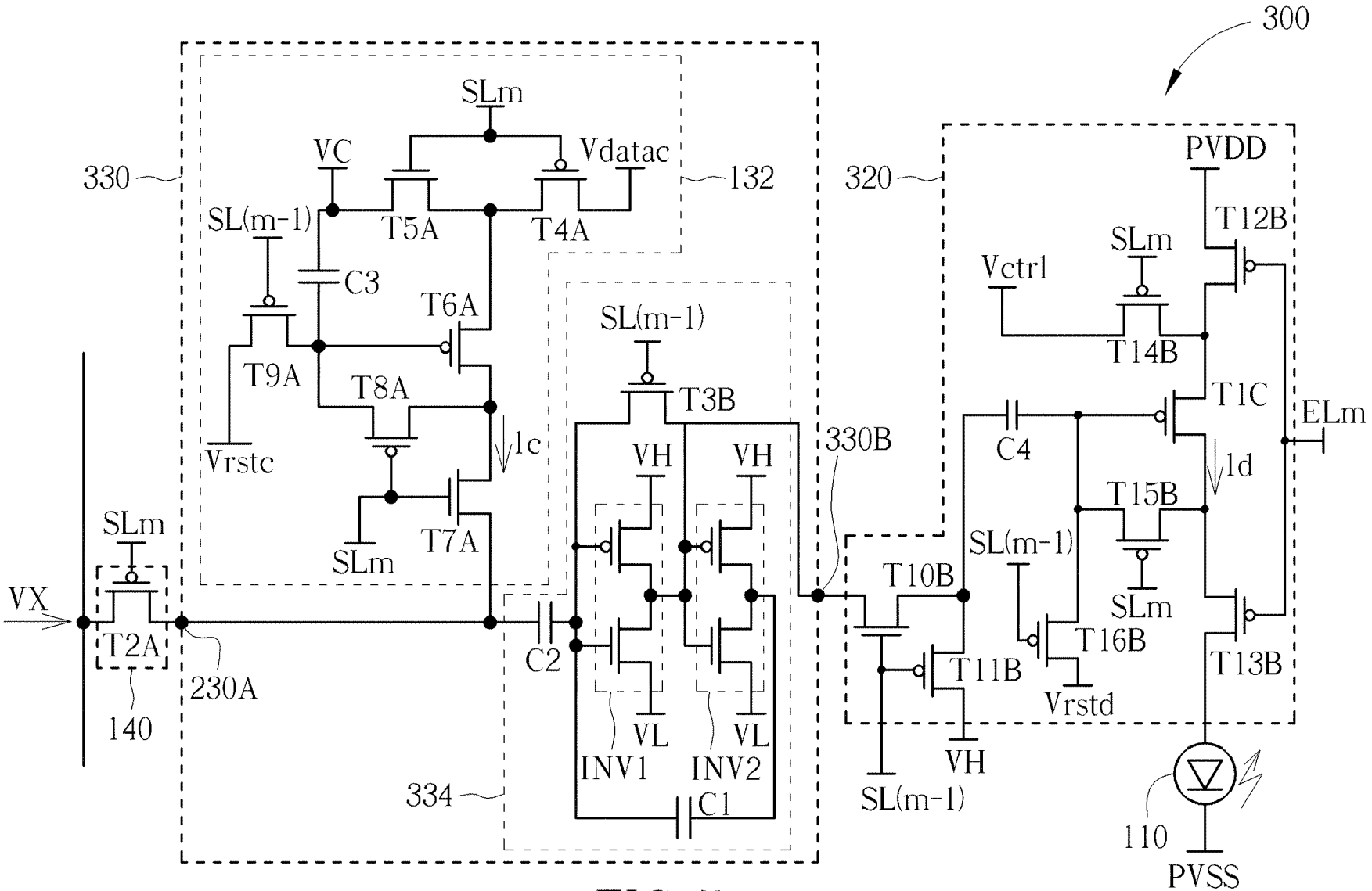
FIG. 5 shows the structures of a pixel circuit according to another embodiment of the present disclosure.

FIG. 5 shows a pixel circuit 300 according to another embodiment. The pixel circuits 300 and 200 have similar structures. However, the output terminal 330B of the voltage to time converter 330 is coupled to the output terminal of the first inverter INV1' in the comparator 334, whereas the output terminal 230B of the voltage to time converter 230 is coupled to the output terminal of the second inverter INV2 in the comparator 234 in FIG. 4. Therefore, when receiving the same input signal, the comparators 234 and 334 may have opposite output voltages.

For example, when the data voltage VX is sampled by the input terminal 330A of the voltage to time converter 330, the voltage to time converter 330 will output the second operation voltage VH, and the first TFT T1C is turned off.

Later, when the input terminal 330A of the voltage to time converter 330 reaches the threshold voltage VT of the comparator 334 from the data voltage VX, the output terminal 330B of the voltage to time converter 330 will change from the second operation voltage VH to the first operation voltage VL, turning on the first TFT T1C.

That is, after the data voltage VX is sampled, the first TFT T1C will be turned off in an initial stage of the scan operation, and will be turned on later in a final stage of the scan operation.

In some embodiments, the third TFT T3B in the comparator 334 may not be necessary if the characteristic variation between the inverters in different pixel circuits is insignificant and can be ignored.

Furthermore, in FIG. 5, the current driver 320 has the same structure as the current driver 220. For example, the control voltage Vctrl would be set to a voltage high enough to turn on the fourteenth transistor T14B and the fifteenth transistor T15B when the current scan line SLm is pulled low to turn on the second TFT T2A for sampling the data voltage VX.

However, in the embodiment shown in FIG. 5, since the first TFT T1C is turned off in the initial stage of the scan operation, the control voltage Vctrl should be high enough to turn off the first TFT T1C before the emitting period of time of the scan operation. That is, generally, the control voltage Vctrl used in the embodiment of FIG. 5 would be higher than the control voltage Vctrl used in the embodiment of FIG. 4. In addition, in the embodiment of FIG. 5, the second terminal of the eleventh TFT T11B can receive the second operation voltage VH instead of VL.

By using the pixel circuits 100(*m, n*), 200 and 300, the display device 10 can drive the LED 110 with a fixed and optimum current. Therefore, the instability caused by current control operation in prior art can be prevented. Furthermore, with the voltage to time converters 130 to 330, the LED 110 can be turned on for a period of time depending on the received data voltage; therefore, the flicker caused by low frequency PWM in prior art can be prevented.

Figure 6:
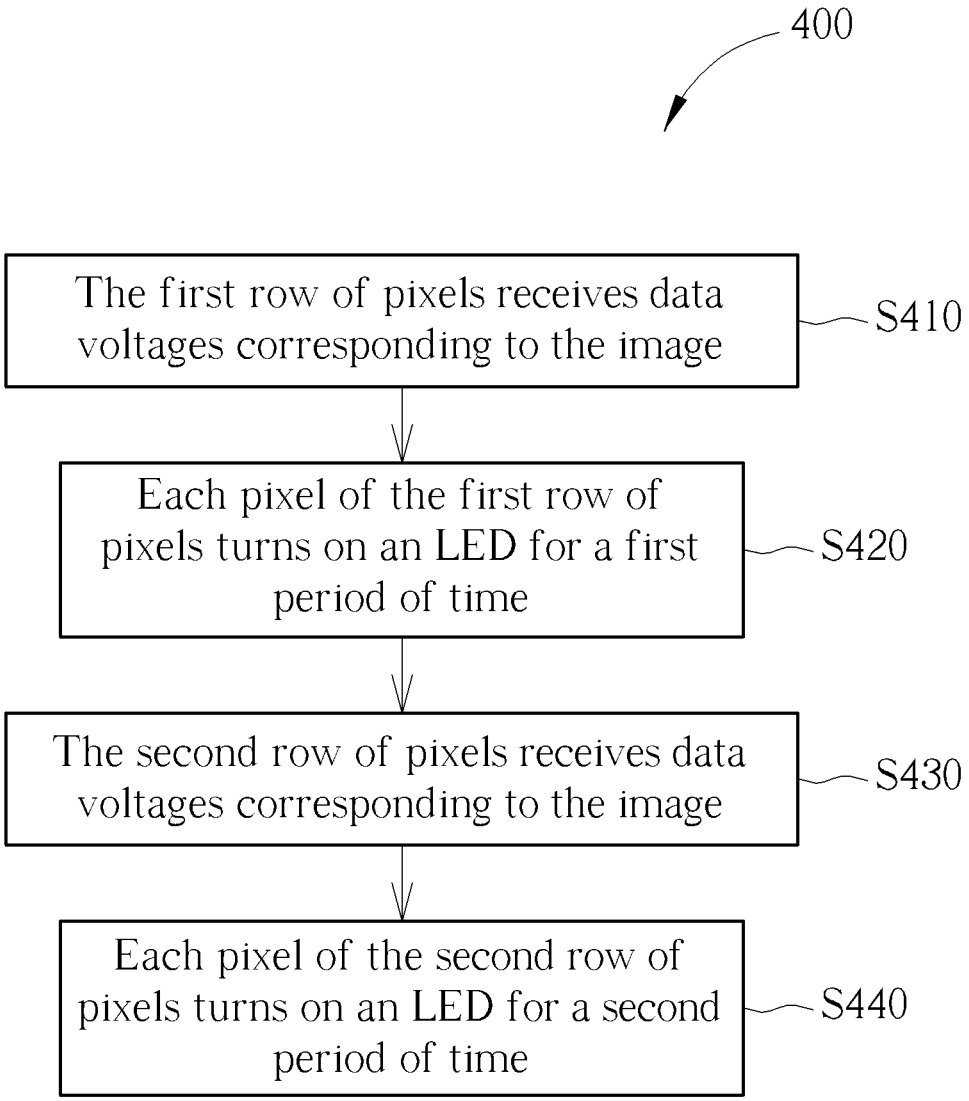
FIG. 6 shows a method for displaying an image with the display device in FIG. 1 according to one embodiment of the present disclosure.

FIG. 6 shows a method 400 for displaying an image with the display device 10 according to one embodiment. The method 400 includes steps S410 to S440. In the present embodiments, since pixel circuits in the same row are coupled to the same scan line, the pixel circuits in the same row can be scanned in the same scan operation. In FIG. 6, the steps S410 and S420 are performed during a first scan operation of the first row of pixels, and the steps S430 and S440 are performed during a second scan operation of the second row of pixels. In addition, the first scan operation begins before the second scan operation.

S410: the first row of pixels receives data voltages corresponding to the image;

S420: each pixel of the first row of pixels turns on a light emitting diode (LED) for a first period of time;

S430: the second row of pixels receives data voltages corresponding to the image;

S440: each pixel of the second row of pixels turns on a light emitting diode (LED) for a second period of time.

In step S410, the first row of pixels can be implemented by the pixel circuits 100(1, 1) to 100(1, N) of the display 10, and can receive the data voltages during the first scan operation. After the data voltages are sampled, each of the pixel circuits 100(1, 1) to 100(1, N) in the first row will turn on its LED for a period of time. Also, if the absolute value of the data voltage received by each of the pixel circuits 100(1, 1) to 100(1, N) is greater, then the period of time would be longer. Or, in some other embodiments, if the grey scale represented by the data voltage received by each of the pixel circuits 100(1, 1) to 100(1, N) is greater, the period of time would be longer.

Similarly, in step S430, the second row of pixels can be implemented by the pixel circuits 100(2, 1) to 100(2, N) of the display 10, and can receive the data voltages during the second scan operation. After the data voltages are sampled, each of the pixel circuits 100(2, 1) to 100(2, N) in the second row will turn on its LED for a period of time, and if the data voltage received by each of the pixel circuits 100(2, 1) to 100(2, N) is greater, then the period of time would be longer. Or, in some other embodiments, if the grey scale represented by the data voltage received by each of the pixel circuits 100(2, 1) to 100(2, N) is greater, the period of time would be longer.

Figure 7:
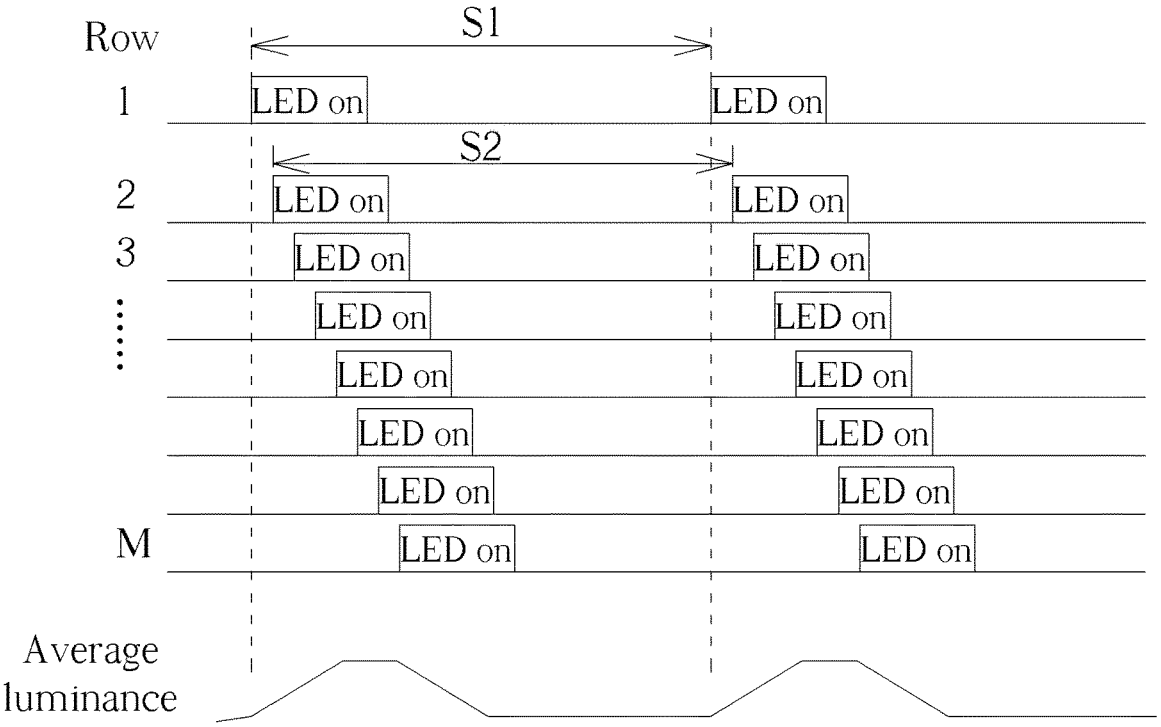
FIG. 7 shows the timing diagram for the scan operations of different rows of pixel circuits in the display device in FIG. 1.

FIG. 7 shows the timing diagram for the scan operations of different rows of pixels in the display device 10. In FIG. 7, the M rows of pixels are sequentially scanned during M different scan operations. That is, the scan lines SL1 to SLM can turn on the second TFTs in the pixel circuits 100(1, 1) to 100(M, N) row by row to pass the corresponding data voltages. Also, to increase the scan frequency and reduce flicker, the succeeding scan operations may overlap with each other for a period of time. For example, in FIG. 7, the second scan operation S2 is started before the first scan operation S1 is completed. Consequently, the variation of average luminance of the display device 10 can be flattened, and the flicker can be reduced.

Figure 8:
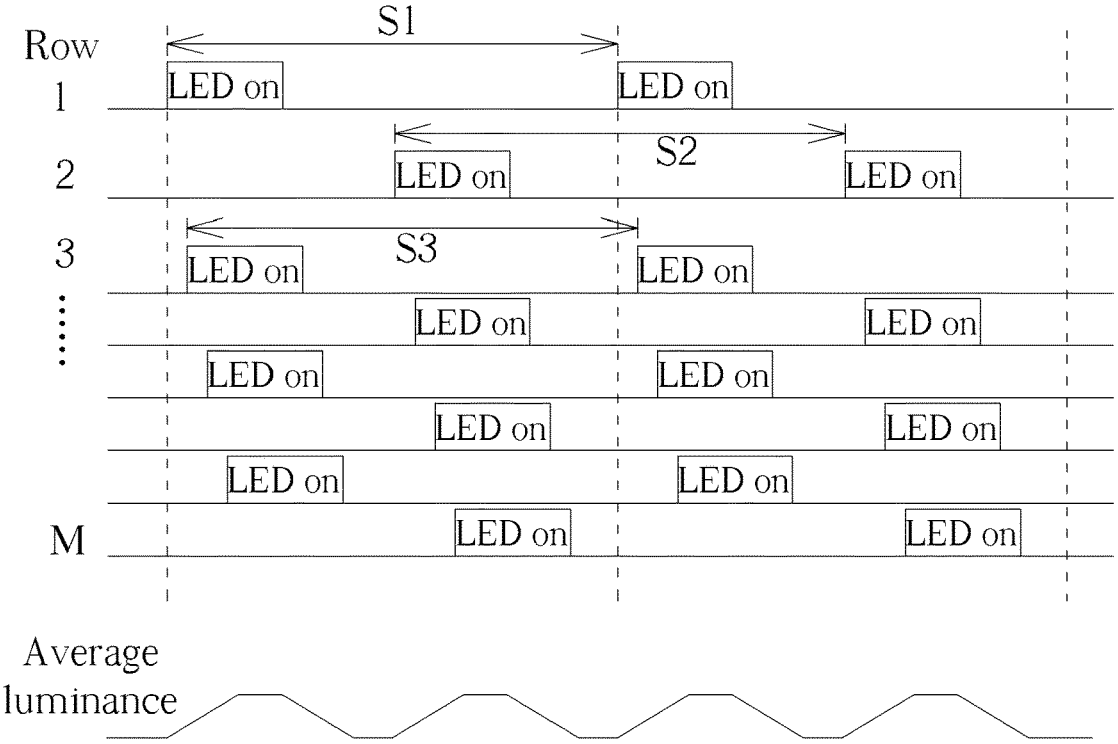
FIG. 8 shows the timing diagram for the scan operations of different rows of pixel circuits in an interlaced manner.

In some embodiments, to further flatten the variation of average luminance of the display device 10, the display device 10 can drive the pixel circuits 100(1, 1) to 100(M, N) in an interlaced manner. FIG. 8 shows the timing diagram for the scan operations of different rows of pixel circuits in an interlaced manner.

In FIG. 8, the first row of pixels and the third row of pixels are assigned to be in a first interlace group, and the second row of pixels is assigned to be in a second interlace filed. In this case, the pixel circuits 100(3, 1) to 100(3, N) in the third row will turn on LEDs in the initial stage of the third scan operation S3. However, although the second row of pixels are disposed between the first row of pixels and the third row of pixels, the third scan operation S3 will begin after the first scan operation S1, and the second scan operation S2 begins after the third scan operation S3 and the first scan operation S1.

That is, in FIG. 8, the odd rows of pixels can be operated as the first interlace group, the even rows of pixel circuits can be operated as a second interlace group, and the second interlace group will start its scan operations after the first interlace group has started its scan operations. Therefore, the emitting periods of time LEDs in the display device 10 can be further decentralized, and the variation of average luminance of the display device 10 can be further flattened, reducing flicker. In some other embodiments, the user can also assign the first interlace group and the second interlace group with different configurations or let the first group start its scan operations after the second group has started its scan operations. Furthermore, in some embodiments, three interlace groups or even more interlace groups can be assigned according to the system requirement. For example, in some embodiments, the first row of pixels, the fourth row of pixels, and the seventh row of pixels can be assigned as the first interlace group, the second row of pixels, the fifth row of pixels, and the eighth row of pixels can be assigned as the second interlace group, and the third row of pixels, the sixth row of pixels, and the ninth row of pixels can be assigned as the third interlace group. Also, the second interlace group can be scanned after the first interlace group is scanned, and the third interlace group can be scanned after the second interlace group is scanned. For example, the scan operation for the second row of pixels is performed after the scan operation for the fourth row of pixels starts, and the scan operation for the third row of pixels is performed after the scan operation for the fifth row of pixels starts.

In addition, in the embodiments shown in FIGS. 7 and 8, the display device 10 uses the pixels 100(1, 1) to 100(M, N) to show the image; therefore, according to the structure and the operation principle aforementioned, the pixel circuits 100(1, 1) to 100(M, N) will turn on their LEDs in the initial stage of their scan operation. For example, as marked in FIG. 7, during the first scan operation S1, the first row of pixels will turn on LEDs in the initial stage of the first scan operation S1, during the second scan operation S2, the second row of pixels will turn on LEDs in the initial stage of the second scan operation S2, and so on.

However, in some embodiments, the display device 10 may also adopt the pixel circuits 300 to implement all the pixels. In this case, during the first scan operation, all pixels of the first row of pixels will turn on the LEDs in the final stage of the first scan operation, and during the second scan operation, all pixels of the second row of pixels will turn on the LEDs in the final stage of the second scan operation.

Furthermore, in some embodiments, the display device 10 may also adopt the pixel circuit 300 to implement parts of the pixels. For example, the display device 10 may adopt the pixel circuits 300 to implement the pixels in the even rows. That is, pixels in the second row, the fourth row, and so on, are implemented by the pixel circuits 300 as shown in FIG. 5. In this case, during the first scan operation, pixels in the first row of pixels will turn on the LEDs in the initial stage of the first scan operation; however, during the second scan operation for the second row of pixels, pixels in the second row will turn on their LEDs in the final stage of the second scan operation. Consequently, the variation of average luminance of the display device 10 can be further flattened, and flicker can be further reduced.

Figure 9:
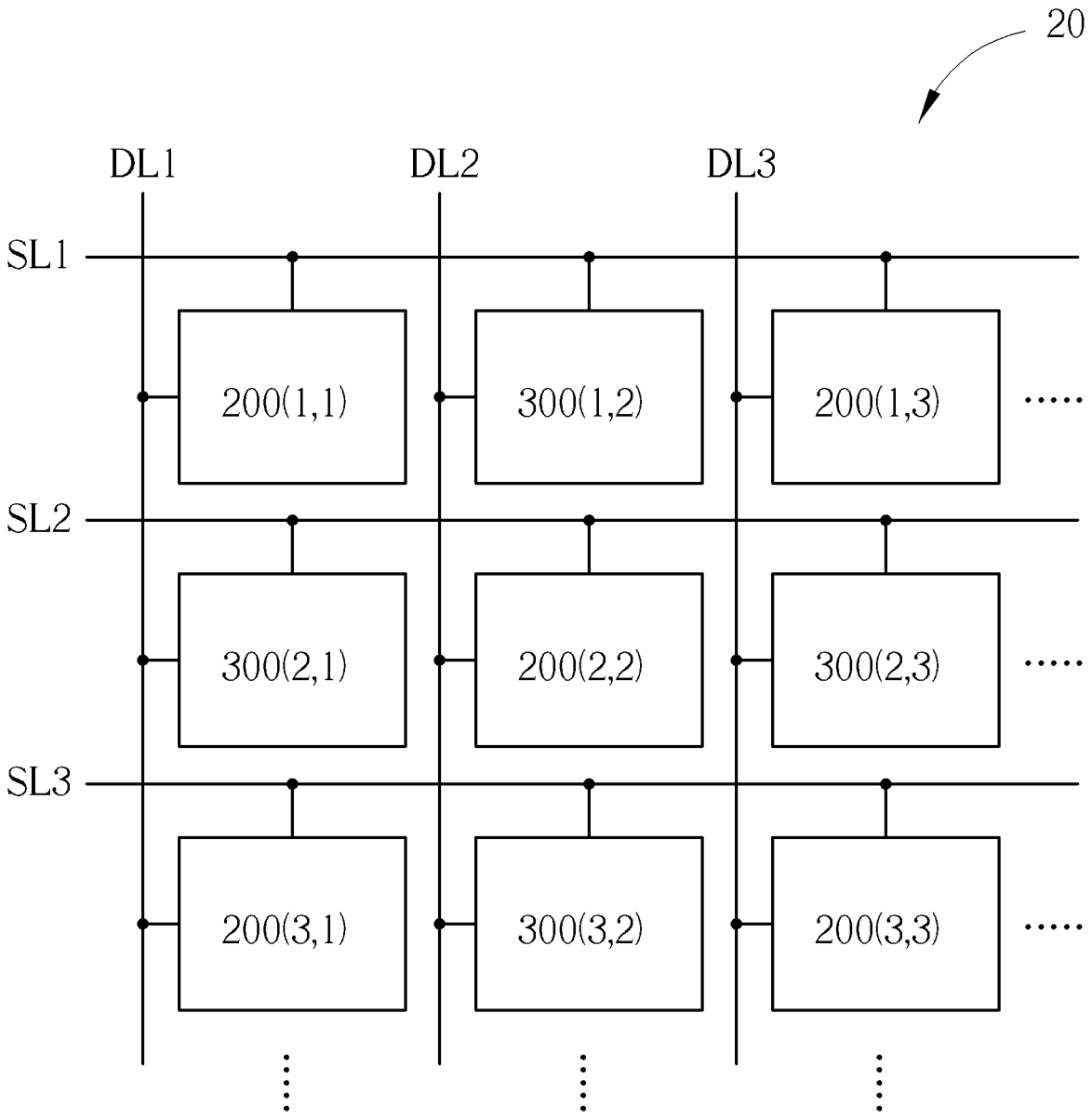
FIG. 9 shows a display device according to another embodiment of the present disclosure.
Figure 10:
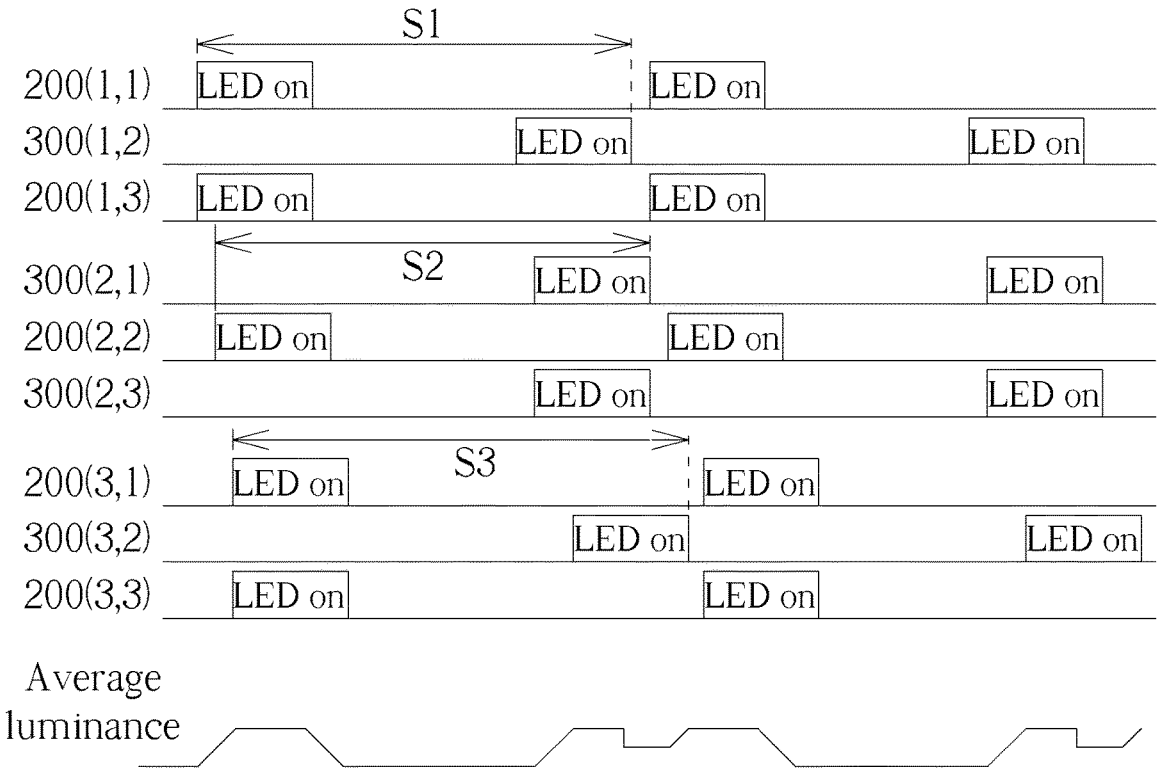
FIG. 10 shows the timing diagram for the scan operations of different rows of pixel circuits in the display device in FIG. 9 according to one embodiment of the present disclosure.

Furthermore, in some other embodiments, the display device 10 may adopt both the pixel circuit 200 and the pixel circuit 300 in one row. FIG. 9 shows a display device 20 according to one embodiment of the present disclosure, and FIG. 10 shows the timing diagram for the scan operations of different rows of pixels in the display device 20 according to one embodiment of the present disclosure.

The display device 20 includes a plurality of rows of pixels, and in each row, each two adjacent pixels can be implemented with different structures and will turn on the LEDs in different stages during the scan operation.

For example, the pixel circuits 200(1, 1) and 200(1, 3) can be implemented by the pixel circuits 200, and the pixel circuit 300(1, 2) can be implemented by the pixel circuit 300. In this case, during the first scan process S1 of the pixels in the first row, the pixel circuits 200(1, 1) and 200(1, 3) will turn on the LEDs in the initial stage of the first scan operation S1 while the pixel circuits 300(1, 2) will turn on the LEDs in the final stage of the first scan operation S1.

Furthermore, during the second scan process S2 of the pixels in the second row, the pixel circuits 300(2, 1) and 300(2, 3) will turn on the LEDs in the final stage of the second scan operation S2 while the pixel circuit 200(2, 2) will turn on the LEDs in the initial stage of the second scan operation S2. Also, during the third scan process S3 of the pixels in the third row, the pixel circuits 200(3, 1) and 200(3, 3) will turn on the LEDs in the initial stage of the third scan operation S3 while the pixel circuit 300(3, 2) will turn on the LEDs in the final stage of the third scan operation S3.

In this case, in the display device 20, each two adjacent pixels are implemented with different structures and will turn on the LEDs in different stages during the scan operation. Consequently, the variation of average luminance within each row of pixel circuits can also be flattened, which further reduces flicker.

Figure 11:
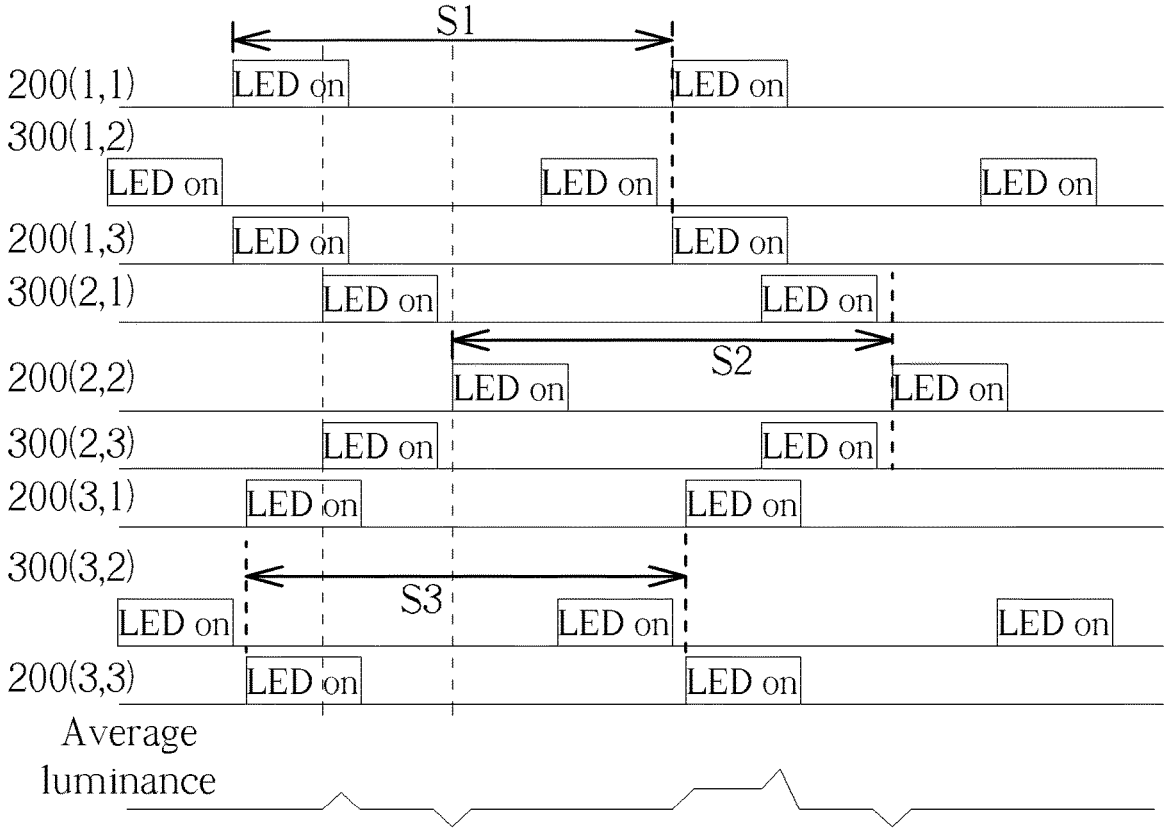
FIG. 11 shows the timing diagram for the scan operations of different rows of pixel circuits in the display device in FIG. 9 according to another embodiment of the present disclosure.

In FIG. 10, different rows of pixels are scanned sequentially; however, in some embodiments, different rows of pixels can also be scanned in an interlaced manner. FIG. 11 shows the timing diagram for the scan operations of different rows of pixel circuits in the display device 20 according to another embodiment of the present disclosure.

In FIG. 11, the odd rows of pixels are operated as a first interlace group, and the even rows of pixel circuits are operated as a second interlace group, and the second interlace group will start its scan operations after the first interlace group has started its scan operations. For example, the third scan operation S3 begins after the first scan operation S1, and the second scan operation S2 begins after the first scan operation S1 and the third scan operation S3. In this case, the variation of the average luminance can be further reduced, suppressing the issue of flicker.

In some other embodiments, the user can also assign the first interlace group and the second interlace group with different configurations or let the first group start its scan operations after the second group has started its scan operations. Furthermore, in some embodiments, three interlace groups or even more interlace groups can be assigned according to the system requirement.

In summary, the display devices and the methods for displaying images with the display device provided by the embodiments of the present disclosure can drive LEDs with fixed and optimum currents. Therefore, the instability caused by current control operation in prior art can be prevented. Furthermore, with the voltage to time converters, the LEDs can be turned on for a period of time with the length of such period of time depending on the received data voltage; therefore, the flicker caused by low frequency PWM in prior art can be prevented. In addition, by driving the pixel circuits with different orders, the variation of average luminance can be flattened and flicker can be reduced. Since the pixel circuit can be designed to turn on the LED in an initial stage or a final stage of the scan operation, adopting different types of pixel circuits in the display device can further decentralize the turn-on period of time of LEDs, improving the display quality of the display device.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device comprising:

at least one data line;

at least one scan line; and at least one pixel circuit, each comprising:

a light emitting diode (LED);

a current driver coupled to the LED, and configured to control the LED, wherein the current driver comprises a first thin film transistor (TFT) having a first terminal, a second terminal, and a control terminal;

a voltage to time converter comprising an input terminal configured to receive a data voltage during a scan operation of the pixel circuit, an output terminal configured to turn on the current driver to generate a predetermined driving current for a period of time, a current source coupled to the input terminal of the voltage to time converter and configured to generate a bias current to the input terminal of the voltage to time converter, and a comparator coupled to the input terminal of the voltage to time converter and the output terminal of the voltage to time converter; and a selection circuit coupled to a current data line of the at least one data line, a current scan line of the at least one scan line, and the input terminal of the voltage to time converter, the selection circuit being configured to transmit the data voltage of the current data line to the voltage to time converter during the scan operation of the pixel circuit, wherein the selection circuit comprises a second TFT having a first terminal coupled to a current data line of the at least one data line, a second terminal coupled to the input terminal of voltage to time converter, and a control terminal coupled to a current scan line of the at least one scan line;

wherein when an absolute value of the data voltage is greater, the period of time is longer; and wherein during the scan operation of the pixel circuit:

the second TFT is turned on by the current scan line to change the input terminal of the voltage to time converter from a prepare voltage to the data voltage, and the output terminal of the voltage to time converter to a first operation voltage or a second operation voltage;

after turning on the second TFT, the second TFT is turned off by the current scan line; and when the input terminal of the voltage to time converter reaches a threshold voltage of the comparator from the data voltage, the output terminal of the voltage to time converter changes from the first operation voltage to the second operation voltage or from the second operation voltage to the first operation voltage.

2. The display device of claim 1, wherein the prepare voltage is higher than the threshold voltage, and the threshold voltage is higher than the data voltage.

3. The display device of claim 1, wherein:

when the input terminal of the voltage to time converter reaches the threshold voltage of the comparator from the data voltage, the output terminal of the voltage to time converter changes from the first operation voltage to the second operation voltage to turn off the current driver; and the comparator comprises:

a first inverter having an input terminal coupled to the input terminal of the voltage to time converter, an output terminal, a first power supply terminal configured to receive the first operation voltage, and a second power supply terminal configured to receive the second operation voltage;

a second inverter having an input terminal coupled to the output terminal of the first inverter, an output terminal coupled to the output terminal of the voltage to time converter, a first power supply terminal configured to receive the first operation voltage, and a second power supply terminal configured to receive the second operation voltage; and a first capacitor having a first terminal coupled to the input terminal of the first inverter, and a second terminal coupled to the output terminal of the second inverter.

4. The display device of claim 1, wherein:

when the input terminal of the voltage to time converter reaches the threshold voltage of the comparator from the data voltage, the output terminal of the voltage to time converter changes from the first operation voltage to the second operation voltage to turn off the current driver; and the comparator comprises:

a first inverter having an input terminal, an output terminal, a first power supply terminal configured to receive the first operation voltage, and a second power supply terminal configured to receive the second operation voltage;

a second inverter having an input terminal coupled to the output terminal of the first inverter, an output terminal coupled to the output terminal of the voltage to time converter, a first power supply terminal configured to receive the first operation voltage, and a second power supply terminal configured to receive the second operation voltage;

a first capacitor having a first terminal coupled to the input terminal of the first inverter, and a second terminal coupled to the output terminal of the second inverter;

a third TFT having a first terminal coupled to the input terminal of the first inverter, a second terminal coupled to the input terminal of the second inverter, and a control terminal coupled to a preceding scan line of the at least one scan line; and a second capacitor having a first terminal coupled to the input terminal of the first inverter, and a second terminal coupled to the input terminal of the voltage to time converter.

5. The display device of claim 1, wherein:

when the input terminal of the voltage to time converter reaches the threshold voltage of the comparator from the data voltage, the output terminal of the voltage to time converter changes from the second operation voltage to the first operation voltage to turn on the current driver; and the comparator comprises:

a first inverter having an input terminal coupled to the input terminal of the voltage to time converter, an output terminal coupled to the output terminal of the voltage to time converter, a first power supply terminal configured to receive the first operation voltage, and a second power supply terminal configured to receive the second operation voltage;

a second inverter having an input terminal coupled to the output terminal of the first inverter, an output terminal, a first power supply terminal configured to receive the first operation voltage, and a second power supply terminal configured to receive the second operation voltage; and a first capacitor having a first terminal coupled to the input terminal of the first inverter, and a second terminal coupled to the output terminal of the second inverter.

6. The display device of claim 1, wherein:

when the input terminal of the voltage to time converter reaches the threshold voltage of the comparator from the data voltage, the output terminal of the voltage to time converter changes from the second operation voltage to the first operation voltage to turn on the current driver; and the comparator comprises:

a first inverter having an input terminal, an output terminal coupled to the output terminal of the voltage to time converter, a first power supply terminal configured to receive the first operation voltage, and a second power supply terminal configured to receive the second operation voltage;

a second inverter having an input terminal coupled to the output terminal of the first inverter, an output terminal, a first power supply terminal configured to receive the first operation voltage, and a second power supply terminal configured to receive the second operation voltage;

a first capacitor having a first terminal coupled to the input terminal of the first inverter, and a second terminal coupled to the output terminal of the second inverter a third TFT having a first terminal coupled to the input terminal of the first inverter, a second terminal coupled to the input terminal of the second inverter, and a control terminal coupled to a preceding scan line of the at least one scan line; and a second capacitor having a first terminal coupled to the input terminal of the first inverter, and a second terminal coupled to the input terminal of the voltage to time converter.

7. A method for displaying an image with a display device, the display device comprising a first row of pixels and a second row of pixels, and the method comprising:

during a first scan operation of the first row of pixel:

the first row of pixels receiving data voltages corresponding to the image; and each pixel of the first row of pixels turning on a light emitting diode (LED) for a first period of time, wherein when an absolute value of a data voltage received by the each pixel of the first row of pixels is greater, the first period of time is longer; and during a second scan operation of the second row of pixels:

the second row of pixels receiving data voltages corresponding to the image; and each pixel of the second row of pixels turning on an LED for a second period of time, wherein when an absolute value of a data voltage received by the each pixel of the second row of pixels is greater, the second period of time is longer;

wherein the first scan operation begins before the second scan operation.

8. The method of claim 7, wherein the second scan operation is started before the first scan operation is completed.

9. The method of claim 7, wherein:

during the first scan operation:

a first pixel of the first row of pixels turns on an LED of the first pixel in an initial stage of the first scan operation; and a second pixel of the first row of pixels turns on an LED of the second pixel in a final stage of the first scan operation.

10. The method of claim 9, wherein the first pixel is adjacent to the second pixel.

11. The method of claim 10, wherein:

during the second scan operation:

a third pixel of the second row of pixels turns on an LED of the third pixel in a final stage of the second scan operation; and a fourth pixel of the second row of pixels turns on an LED of the fourth pixel in an initial stage of the second scan operation; and the first pixel and the third pixel are disposed in a same column, and the second pixel and the fourth pixel are disposed in a same column.

12. The method of claim 11, wherein:

the second row of pixels is adjacent to the first row of the pixels; and the third pixel is adjacent to the first pixel, and the fourth pixel is adjacent to the second pixel.

13. The method of claim 11, wherein:

the display device further comprises a third row of pixels;

the second row of the pixels is disposed between the first row of pixels and the third row of pixels;

during a third scan operation:

a fifth pixel of the third row of pixels turns on an LED of the fifth pixel in an initial stage of the third scan operation; and a sixth pixel of the third row of pixels turns on an LED of the sixth pixel in a final stage of the third scan operation;

the third scan operation begins after the first scan operation; and the second scan operation begins after the first scan operation and the third scan operation.

14. The method of claim 7, wherein:

during the first scan operation, all pixels of the first row of pixels turn on LEDs in an initial stage of the first scan operation.

15. The method of claim 14, wherein:

during the second scan operation, all pixels of the second row of pixels turn on LEDs in an initial stage or a final stage of the second scan operation.

16. The method of claim 15, wherein:

the display device further comprises a third row of pixels;

the second row of the pixels is disposed between the first row of pixels and the third row of pixels;

during a third scan operation, all pixels of the third row of pixels turn on LEDs in an initial stage of the third scan operation or a final stage of the third scan operation;

the third scan operation begins after the first scan operation; and the second scan operation begins after the third scan operation and the first scan operation.

17. The method of claim 7, wherein:

during the first scan operation, all pixels of the first row of pixels turn on LEDs in a final stage of the first scan operation; and during the second scan operation, all pixels of the second row of pixels turn on LEDs in a final stage of the second scan operation.

18. The method of claim 17, wherein:

the display device further comprises a third row of pixels;

the second row of the pixels is disposed between the first row of pixels and the third row of pixels;

during a third scan operation, all pixels of the third row of pixels turn on LEDs in an final stage of the third scan operation;

the third scan operation begins after the first scan operation; and the second scan operation begins after the third scan operation and the first scan operation.

* * * * *